United States Patent [19]

Fogleman

[11] Patent Number: 5,076,347

[45] Date of Patent: Dec. 31, 1991

[54] INDIRECT EVAPORATIVE COOLER

[75] Inventor: Sam F. Fogleman, Burlingame, Calif.

[73] Assignee: Coolex, Inc., Idaho Falls, Id.

[21] Appl. No.: 615,230

[22] Filed: Nov. 19, 1990

[51] Int. Cl.[5] ..... F28D 3/02; F28F 1/40

[52] U.S. Cl. ..... 165/118; 165/183; 165/905; 29/890.049

[58] Field of Search ..... 165/183, 179, 118, 905; 29/890.049

[56] References Cited

U.S. PATENT DOCUMENTS

| | | | |
|---|---|---|---|
| 2,032,134 | 2/1936 | Larkin . | |
| 2,074,642 | 3/1937 | Coverston | 62/139 |
| 3,275,074 | 9/1966 | Campbell et al. | 62/314 |
| 3,877,244 | 4/1975 | Di Peri | 62/314 |
| 3,882,011 | 5/1975 | Hines et al. . | |
| 4,023,949 | 5/1977 | Schlom et al. | 62/309 |
| 4,163,474 | 8/1979 | MacDonald et al. | 29/890.049 |

FOREIGN PATENT DOCUMENTS

| | | | |
|---|---|---|---|
| 1937358 | 2/1971 | Fed. Rep. of Germany | 29/890.049 |
| 73094 | 4/1987 | Japan | 165/183 |

*Primary Examiner*—Albert W. Davis, Jr.

*Attorney, Agent, or Firm*—Robert A. de Groot; Stephen A. Gratton

[57] ABSTRACT

An indirect evaporative cooler having an improved heat exchanger. The heat exchanger includes a plurality of heat tubes arranged in a closely spaced vertically stagger matrix and with each tube having an internal fin mounted therein. The heat transfer tubes and internal fins are distortion fitted to one another to provide a heat conductive bond between the internal fins and the exterior of the heat transfer tubes. Additionally, the heat transfer tubes are arranged in a novel matrix with improved heat transfer characteristics.

12 Claims, 3 Drawing Sheets

INDIRECT EVAPORATIVE COOLER

FIELD OF THE INVENTION

This invention relates to evaporative coolers and, more particularly, to an indirect evaporative cooler having a new and improved heat exchanger.

BACKGROUND OF THE INVENTION

Evaporative coolers are well known in the art. In general, these coolers rely on the evaporation of water to lower the wet bulb temperature of an air stream. Traditional direct air evaporative cooling systems simply draw air through wetted, chemically treated filter pads. Movement of the air through the pads evaporates water and cools the air. In direct air evaporative coolers, this air is utilized as a primary air stream for air conditioning and other applications. Such direct air evaporative cooling systems are most efficient in conditions of low humidity.

Indirect evaporative cooling systems combine the evaporative cooling effect in a secondary air stream. A heat exchanger is utilized to produce cooling in the primary air stream without the addition of moisture. In general, an indirect or dry evaporative cooler may include tubes containing flowing warm air on the inside, which is to be cooled by falling water on the outside of the tubes. A secondary scavenger air stream may also be included for contact with the falling water for removal of heat by evaporation. This secondary air stream may then be demoisturized and exhausted.

Indirect evaporative coolers have been proven in the art as able to cool buildings at one-third the electrical power demand of refrigeration units. This produces two-thirds less effluents from coal, oil, and gas fired power plants and helps to reduce various atmospheric pollutants. Carbon dioxide effluents contributing to the greenhouse effect, sulphur dioxide effluents contributing to acid rain, and nitrous oxides effluents contributing to smog are all reduced. Additionally, chlorine-based refrigerants are not needed and degradation of the earth's ozone layer is reduced. Moreover, indirect coolers can be used to supply all outside air to buildings to remove indoor air pollutants such as smoke and odors.

Existing evaporative coolers of the dry or indirect type, however, do not presently hold a large share of the market for cooling of buildings. In competition with other types of cooling, there are the disadvantages of higher first cost, greater bulk, lower cooling efficiency, unsuitable methods for retaining water on the wet sides of the tubes, and increased maintenance costs.

The present invention is directed to an indirect evaporative cooling system with a novel heat exchanger which overcomes some of these prior art problems and provides an efficient, compact, and relatively inexpensive system.

SUMMARY OF THE INVENTION

In accordance with the present invention, an indirect evaporative cooler is provided. The evaporative cooler includes a novel heat exchanger comprising a matrix of heat transfer tubes. The primary air stream is directed through the heat transfer tubes and cooled by cascading water flow over the tubes. A scavenger air flow is also directed across the outside of the heat transfer tubes for removal of heat by evaporation and is exhausted.

The heat transfer tubes are formed with a novel internal fin construction which increases the heat exchange surface with the primary air stream flowing within the heat transfer tubes. Additionally, the heat transfer tubes are aligned in a matrix which increases the efficiency of heat transfer within the heat exchanger.

The internal fin construction of the heat transfer tubes increases the total area of heat transfer surfaces in the heat exchanger by more than four times. In accordance with the invention, the internal fins are placed into the heat transfer tubes by a unique procedure which ensures high thermal bonding contact between the internal fins and the heat transfer tubes. This improved construction permits a more efficient and compact heat exchanger with reduced overall equipment bulk, cabinet enclosure size, and initial cost. At the same time, heat transfer efficiency is improved.

This unique assembly procedure involves forming a metal fin into an accordion-like shape and press fitting the fin into a then-walled plastic tube. During assembly, the plastic tube is pressed on opposite sides and elongated in cross-section to allow the metal fin to be slipped into the tube. When the side load is removed, the heat transfer tube returns to almost its original shape but with the internal fin under a compressive load and thermally bonded to the interior of the heat transfer tube.

To form the heat exchanger, a plurality of heat transfer tubes are arranged in a matrix in which a streamline surface of the heat transfer tubes faces the air stream to minimize air pressure drop. Additionally, the heat transfer tubes are shaped and arranged to provide water retention on the exterior of the tubes for efficient heat transfer from the tubes to the cascading water flow.

Other objects, advantages, and capabilities of the present invention will become more apparent as the description proceeds.

DETAILED DESCRIPTION OF THE INVENTION

Figure 1:
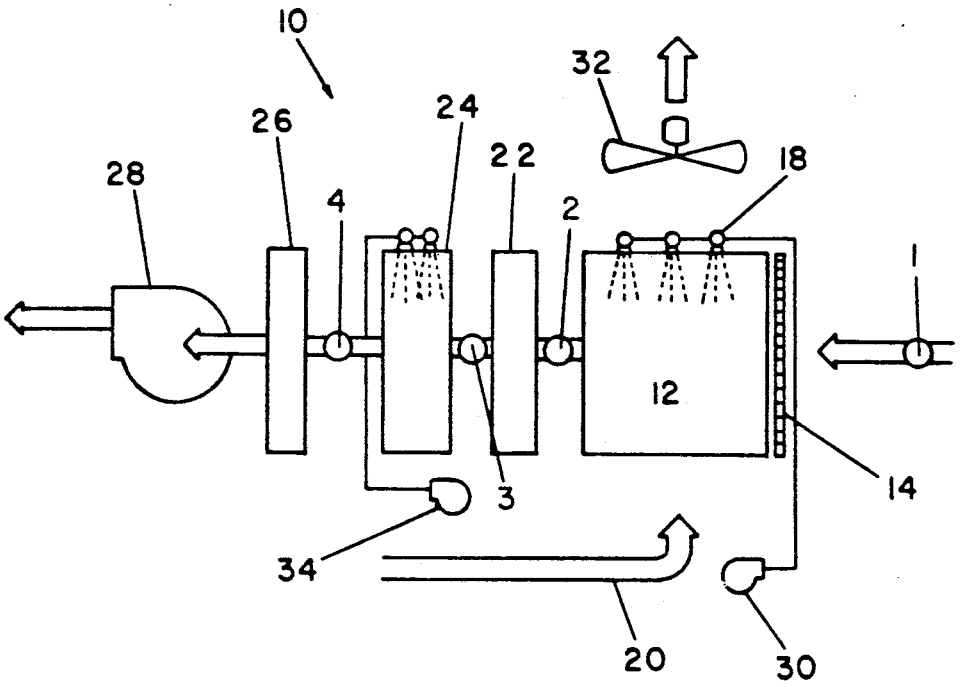
FIG. 1 is a schematic view of an indirect evaporative cooler constructed in accordance with the invention.

Referring now to FIG. 1, an indirect evaporative cooling system constructed in accordance with the invention is shown and generally designated as 10. The cooling system 10 includes a dry indirect cooler or heat exchanger !2 wherein air from an outside air supply is indirectly cooled by the evaporation of water. A filter element 14 may be located at the inlet of the heat exchanger 12.

The heat exchanger 12 includes a plurality of heat transfer tubes 16 (FIG. 2) arranged in a matrix (FIG. 4) through which the outside air supply is directed. A plurality of water sprays 18 (FIG. 1) cascade water over the exterior surfaces of the heat transfer tubes 16 for cooling the outside air supply flowing within the heat transfer tubes 16. The water sprays 18 are supplied by an indirect water pump 30. A scavenger air stream 20 may be directed through the matrix of heat transfer tubes 16 to aid in the evaporation of water cascading over the exterior surface of the heat exchange tubes 16. The heat-laden scavenger air stream 20 may then be exhausted through a moisture separation 32 as shown in FIG. 1.

The indirect evaporative cooling system 10 may further include an optional cooling coil 22 and a wet/-direct evaporative cooler 24 for further cooling the conditioned air. The wet direct cooler 24 may include a direct pump 34 which pumps water onto a wetted surface with the conditioned air directed therethrough as is known in the art. The system 10 may include a supply air blower 28 for moving the conditioned air through the system.

Figure 3:
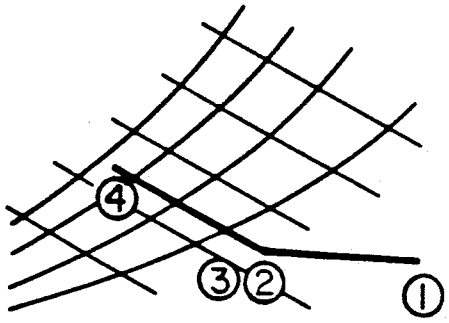
FIG. 3 is a graph showing dry bulb temperature versus absolute humidity of air processed in accordance with the invention.

A representative curve showing the dry bulb temperature versus the absolute humidity of the conditioned air is shown in the graph of FIG. 3. This graph shows the temperature of the air at points 1, 2, 3, and 4 (FIG. 1) as it passes through the system 10.

Figure 2:
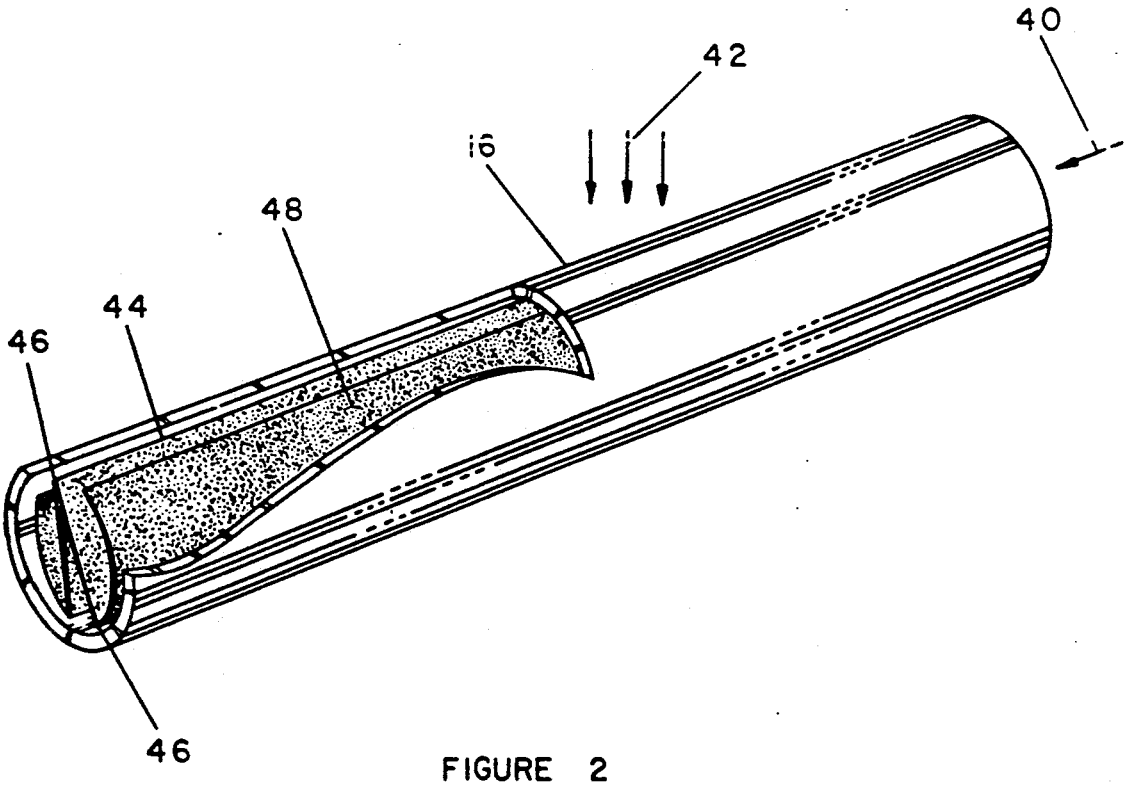
FIG. 2 is a perspective view of a heat transfer tube constructed in accordance with the invention.

Referring now to FIG. 2, a single heat transfer tube 16 is shown. As previously stated, outside air is directed as indicated by arrow 40, through the inside of the heat transfer tube 42. Water is cascaded as indicated by arrows 42 over the outside surface of the heat transfer tube.

Figure 6:
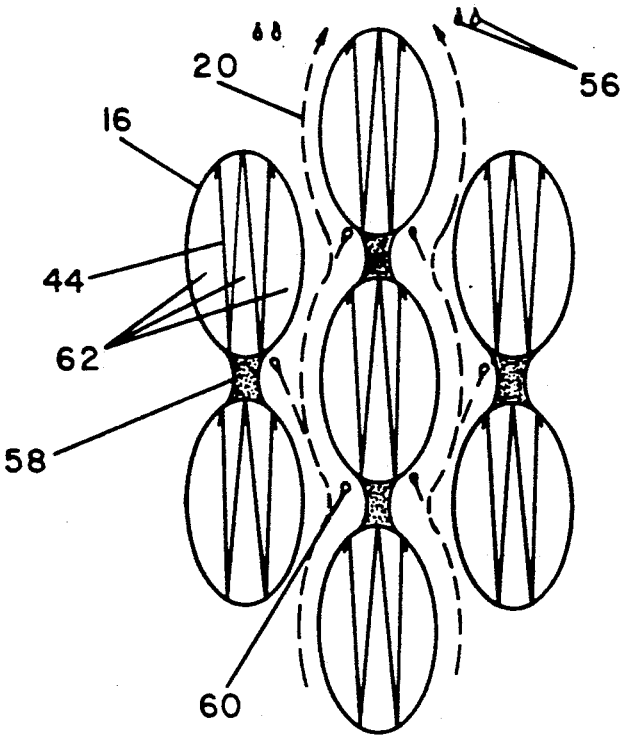
FIG. 6 is a schematic view showing a cross-section through a heat exchanger constructed in accordance with the invention and the arrangement of a matrix of heat transfer tubes with water and scavenger air flow therethrough.

Each heat transfer tube 16 includes an internal fin 44. This heat transfer tube 16, as will hereinafter be more fully explained, is constructed by a process shown schematically in FIG. 5. Additionally, a plurality of heat transfer tubes 16 can be arranged in a matrix as shown in FIG. 6 and which will hereinafter be more fully explained to form the heat exchanger 12.

The heat transfer tubes 16 can be used to provide heating or cooling of gases or fluids, each separated from each other on the opposite sides of the tube interior and exterior. This heat transfer tube 16 construction and matrix arrangement of the invention provides an improved heat exchanger 12 with an increased total surface area per unit of volume occupied and with improved efficiency.

The following inventive concepts are involved:

1. Increasing the total surface area of heat transfer by inserting internal fins 44 of thin metal within tubes with an efficient thermal bond between the thin-walled heat transfer tube 16 and the internal fins 44. This bond is obtained from the inherent flexible properties of the tube 16 and fin 44 with their contact surfaces put under intense pressure in a unique assembly method.
2. Gases or fluids flowing over the outside of the heat transfer tubes 16 provide reduced friction to flow by forming the tubes with a generally elliptical cross-sectional configuration. This low-friction shape is provided by the inherent flexible properties of the tube material. Thus, the narrow, streamlined heat transfer tubes 16 can be spaced closer together resulting in a more compact heat exchanger 12.
3. A novel assembly procedure is provided for bonding the internal fins 44 to the heat transfer tubes 16.

In a preferred embodiment of the invention, a heat transfer tube 16 is constructed of a thin-walled plastic tubing. The internal fin 44 is constructed of a thin metallic sheet such as aluminum. The internal fin 44 is formed in a pleated shape with sharp folded edges 46 (FIG. 2). The internal fin 44 may be constructed in a variety of shapes including the pleated shape with arcuate sides shown in FIG. 2 or the accordion-like pleated shape shown schematically in FIGS. 5 and 6. It is critical that a heat conductive thermal bond be established between the internal fin 44 and the heat transfer tube 16. This heat conductive bond may occur, for example, at the sharp folded edge 46 (FIG. 2) formed on the internal fin 44 where the sharp folded edge 44 contacts the internal wall of the heat transfer tube 16. The internal fin 44 is preferably formed to provide an increased surface area (example 4 x) with an acceptable pressure drop of air flow through the heat transfer tube 16.

A novel process for assembling a heat transfer tube 16 is shown in FIG. 5. The first view shows a side view of a thin-walled plastic tube prior to insertion of the internal fin 44. The plastic tube may have a length of, for example, twelve to seventy-two inches. As shown in the first view, the plastic tube has a generally circular cross-sectional configuration prior to insertion of the internal fin 44.

In the second view, the shape of the internal fin 44 prior to insertion into the thin-walled plastic tube is shown. As shown, the internal fin 44 is formed with a generally accordion-like pleated shape. The pleats of the internal fin 44 are formed with a length which is greater than the internal diameter of the thin walled plastic tube of the heat transfer tube 16. Prior to insertion of the internal fin into the plastic tube, the sharp folded edges of the pleats extend past the plastic tube which is shown in phantom in the second view, by a distance "X". After assembly, the sharp folded edges 46 are forced into contact with the inside diameter of the thin-walled plastic tube to form a heat conductive bond therebetween. In addition to the internal fin 44, shaped as shown in FIG. 5, with five sharp folded edges 46, an internal fin 44 with fewer or greater number of sharp folded edges 46 may also be formed. Additionally, the internal fin 44 may be formed with an arcuate shaped pleat 48 (FIG. 2) for contacting the arcuate internal walls of the heat transfer tube 16.

With reference to the third view of FIG. 5, during assembly a compressive side load denoted by arrows 50,52 is applied to the thin-walled plastic tube. This deforms the plastic tube into a generally elliptical cross-sectional configuration and allows the internal fin 44 to be inserted into the plastic tube to form the heat transfer tube 16.

The fourth view shows the thin-walled plastic tube which returns to a generally elliptical cross-sectional configuration (exaggerated in FIG. 5) upon removal of the compressive assembly load (50,52). With this arrangement, the sharp folded edges 46 of the internal fin 44 are pressed into compressive engagement with the inside wall of the thin-walled plastic tube of the heat transfer tube 16. This forms a path for heat conduction between the internal fin 44 and the exterior surface of the heat transfer tube 16.

The individual pleats of the internal fins 44 do not have sufficient load carrying capacity as columns because of their tendency to buckle under load. As a group of generally parallel columns, however, the pleats of the internal fin 44 share the load carrying capacity to reduce the tendency of the tube to buckle. Thus, with an improved load carrying capacity, the internal fins 44 maintain reactive forces against the inside of the thin walls of the heat transfer tubes 16 and force the heat transfer tubes 16 into a generally elliptical shape. This creates large tensile stresses in the distorted walls of the heat transfer tube 16 so that at the mating surfaces of the sharp folded edges 46 of the internal fins 44 intense reactive compression pressures are maintained to provide good thermal bonds for high heat transfer. Dimension "Y" in the fourth view of FIG. 5 shows the amount of narrowing of the tube widths as caused by each heat transfer tube 16 being forced into a generally elliptical shape. For a given tube length, which remains nearly constant, an increase in the height of the tube "X" requires that the width of the tube be proportionately narrowed "Y".

The useful features of efficient thermal bonds, narrowed tubes and more streamlined elliptical shapes are obtained using the inherent flexible properties of the thin-walled plastic tubes together with the rigid internal fins 44 formed with multiple pleats acting as a group of columns. The pleats of the internal fins 44, considering both sides of the pleat, increase the total secondary surface area in direct proportion to the number of pleats. With an increase in the number of fin pleats to share the compression loads, the fin thickness may be decreased for improved economy while high conduction efficiency is enhanced. Employing the tube and fin configuration shown in FIG. 5 permits the construction of a heat exchanger 12 that contains four or more times the total surface area per unit volume of the equipment.

FIG. 6 is a section of the heat exchanger 12 showing an assembly matrix for the heat transfer tubes 16. In FIG. 6, the distortion compromised heat transfer tubes 16 are assembled in the heat transfer 12 with the major axis of their elliptical-like shapes oriented in vertical planes. This provides the least practical friction to the scavenger air stream 20. The vertical rows of heat transfer tubes 16 are arranged to be staggered between adjacent vertical rows so that a serpentine-like flow path is created for the upward flow of the scavenger/exhaust air stream 20, which, evaporates the cascading water to provide a cooling source for the apparatus. Water drops 56 (FIG. 6) are sprayed downward over the rows of heat transfer tubes 16. The placement of the heat transfer tubes 16 in close proximity allows the water to form reservoirs 58 between the tubes 16. The surplus water then falls to the next lower bank of heat transfer tubes 16. The small water reservoirs 58 are retained in the positions as shown in FIG. 6 between the closely spaced heat transfer tubes !6 by the surface tension of water. Surplus amounts of cascading water 56 leave the reservoir 10 to fall to the next lower row of heat transfer tubes 16. A minimum amount of water, however, is retained in each reservoir 58 by surface tension. In use, cascading water 56 will temporarily be mixed and entrained into the rising scavenger air stream 20. The unique serpentine-like air flow path, however, bends or deflects the scavenger air stream 20 to cause turns by passing over each row of tubes 16. As the flow direction is changed, the low density air 20 curves through the air path as directed by the enclosing tube boundaries. The higher density water drops 60, however, being of the same velocity as the air 20 have a higher inertia which tends to cause the water drops 20 to flow straight at each air path bend. The straight flowing water drops 20 contact the surface of the heat transfer tubes 16 and the drops 60 then fall into the reservoir 58. In this manner, the orientation of heat transfer tubes 16 operates as a moisture eliminator to preclude the entrainment of water drops 60 in the scavenger air stream 20 leaving the system. The reservoirs of water 58 are retained as desirable small reservoirs to ensure a constant cooling source for each tube 16 even during periods of momentary dry spells caused by uneven water distribution. The dry air 62 to be cooled is passing inside the tubes 16 flows between the internal fins 44 in directions perpendicular to the plane of FIG. 6.

Staggered tube arrangements in heat exchangers are not new in the art. In this novel matrix arrangement, however, the tubes 16 are in vertically straight, staggered row patterns for low-friction air flow between the tubes 16. The staggered pattern consists of alternating the mounting heights of tubes 16 in one vertical row versus the mounting heights in adjacent vertical rows, so that the above-described serpentine paths between tube rows are created.

Figure 4:
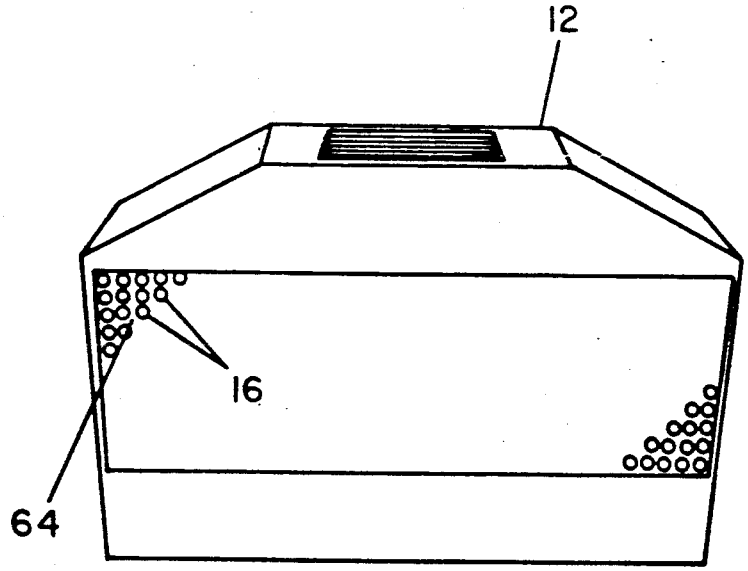
FIG. 4 is a perspective view of a heat exchanger having heat transfer tubes constructed and assembled in a matrix in accordance with the invention.
Figure 5A:
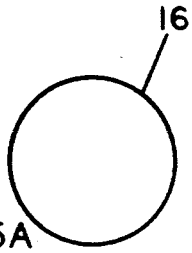
FIG. 5 is a schematic view showing a sequence of steps for constructing a heat transfer tube having an internal cooling fin formed in accordance with the invention.
Figure 5B:
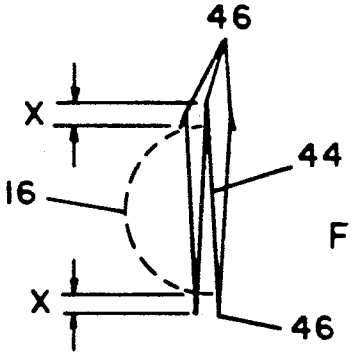
Figure 5C:
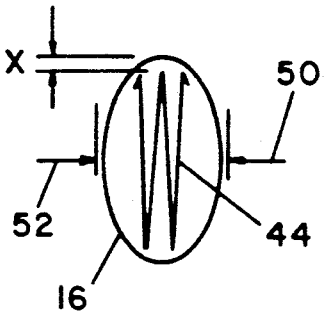
Figure 5D:
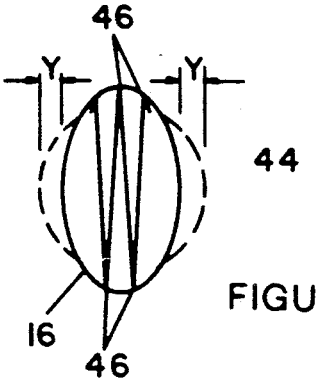

FIG. 4 shows the general arrangement of heat exchanger 12 including a series of horizontal tubes 16 arranged in accordance with the invention. The heat transfer tubes 16 are mounted and sealed as shown on tube sheets 64. Recirculating or cascading water is sprayed over the outside of the tubes, falls to a water sump (not shown) where the indirect water pump 30 (FIG. 1) picks up the water for recirculation over the outside of the tubes 16. Exhaust or scavenger air 20 enters from the outside and is drawn into the bottom of the heat exchanger 12 for passage over the outside of the tubes 16. The exhaust air passing upward contacts the cascading water falling over the outside of the tubes 16. Dry air directed through the inside of the heat transfer tubes 16 is cooled by heat transfer from the tubes 16 before being passed on to the building to be cooled.

Thus, the invention provides an efficient, compact, and low-cost indirect heat exchanger which can be built with less labor for cooling and heating of gases and fluids. This indirect heat exchanger includes heat transfer tubes sealingly connected to tube sheets. The following five major inventive concepts are included herein:

1. Use of a novel joint mating called "distortion compromised fit" to secure secondary heat transfer fins to the inside of round or elliptically shaped tubes under intense pressure to obtain thermal bonds of high efficiency. The new joint mating method is used with thin-walled parts whereby the dimensional interference between the mating surfaces is so large that one or both parts are significantly distorted in shape, from their pre-assembled configurations, when assembled together. Thus, the distortion of the tube forms high compressive stresses on the fins, producing intense pressure at the contact surfaces for a good thermal bond.
2. Use of the distortion compromised fit to deform the heat transfer tubes from pre-assembly arcular shapes into generally elliptical shapes which can be oriented to air flow so that more streamlined flow paths are produced. A more compact exchanger can then be built.
3. Use of an assembly procedure using only the inherent properties of thin-walled tube and thin metallic fins to obtain a bond without damage or distortion of the fins.

4. Use of an arrangement of heat transfer tubes in vertically straight rows with alternately staggered tubes to present a serpentine path to the flow of exhaust/scavenger air to effect separation of water drops from the flowing air stream.

5. Placement of heat transfer tubes in a bank in close vertical proximity to each other to provide for a space between the heat transfer tubes to cause the retention of water by surface tension.

While a preferred embodiment of the invention has been disclosed, various modes of carrying out the principles disclosed herein are contemplated as being within the scope of the following claims. Therefore, it is understood that the scope of the invention is not to be limited except as otherwise set forth in the claims.

What is claimed is:

1. An indirect evaporative cooler comprising:

a plurality of heat transfer tubes formed of thin-walled tubing having an internal fin mounted therein with each internal fin formed with accordion-like pleats bonded to an inside wall of the tubing by a distortion fit between a sharp folded edge of the internal fin and compression loads from distorting the thin-walled tubing;

means for cascading water over an exterior surface of the heat transfer tubes;

means for directing a scavenger air flow through the cascading water for evaporation; and means for directing dry air to be cooled through the heat transfer tubes.

2. The evaporative cooler as recited in claim 1 and wherein:

the heat transfer tubes are assembled in a closely spaced matrix of vertically staggered rows whereby a serpentine flow of scavenger air is provided and reservoirs of water form between adjacent heat transfer tubes.

3. The evaporative cooler as recited in claim 1 and wherein:

each heat transfer tube is formed by distortion fitting an internal fin into a thin-walled tubes by forming the internal fin with pleat lengths greater than an inside diameter of the thin-walled tube and by applying a side load to the plastic tube during assembly.

4. The evaporative cooler as recited in claim 1 and wherein:

the heat transfer tubes are formed of thin-walled plastic tubing with metallic fins therein.

5. The evaporative cooler as recited in claim 1 and wherein:

the heat transfer tubes are mounted and sealed to tube sheets.

6. In an indirect evaporative cooler, the improvement comprising:

a heat exchanger formed of a plurality heat transfer tubes formed in a matrix of vertically staggered rows and including:

a. a plurality of thin-walled plastic tubes having an inside diameter;

b. a plurality of metallic fins formed with accordion-like pleats having sharp folded edges with the metallic fins having pleat lengths greater than the inside diameter of the plastic tubes and with a compressive load applied to the thin-walled plastic tube during assembly for inserting the metallic fins to produce a compression fit between the metallic fins and plastic tubes whereby a thermally conductive bond is formed between the sharp folded edges of the internal fins and the thin-walled plastic tube.

7. An improved indirect evaporative cooler as recited in claim 6 and wherein:

the heat transfer tubes are formed in a matrix wherein air flow is directed between the heat transfer tubes in a serpentine direction and in which the heat transfer tubes are closely spaced to form water reservoirs therebetween.

8. An improved indirect evaporative cooler as recited in claim 7 and wherein:

the internal fins include four pleats for increasing a heat transfer surface by a factor of four.

9. An improved indirect evaporative cooler as recited in claim 8 and wherein:

the internal fins include an arcuate-shape pleat for contacting an arcuate internal surface of the thin-walled plastic tube.

10. In an evaporative cooler in which dry air is directed through a plurality of heat transfer tubes and water is cascaded over the heat transfer tubes for cooling the dry air, a heat exchanger comprising:

a plurality of heat transfer tubes arranged in vertically staggered rows with each tube including an internal fin formed with accordion-like pleats and sharp folded edges;

a distortion fit between the heat transfer tubes and internal fins formed by forming the fins larger than an internal diameter of the heat transfer tubes and by deforming the heat transfer tubes by side loading during assembly;

whereby a heat conductive bond is formed between the sharp folded edges of the internal fins and the heat transfer tubes.

11. The evaporative cooler as recited in claim 10 and wherein:

the heat transfer tubes are arranged in a closely spaced matrix in which water reservoirs are formed between adjacent tubes.

12. The evaporative cooler as recited in claim 10 and wherein:

the heat transfer tubes are deformed to a generally elliptical shape with the tubes arranged with a major axis of the ellipse parallel to a direction of scavenger air flow.

* * * * *